US006382859B2

(12) United States Patent
Noguchi et al.

(10) Patent No.: US 6,382,859 B2
(45) Date of Patent: May 7, 2002

(54) DOUBLE CHUCK TYPE MECHANICAL PENCIL AND INTERNAL WRITING MECHANISM THEREOF

(75) Inventors: Yoshio Noguchi; Hidehei Kageyama, both of Kawagoe (JP)

(73) Assignee: Kotobuki & Co., Ltd., Kyoto (JP)

( * ) Notice: Subject to any disclaimer, the term of this patent is extended or adjusted under 35 U.S.C. 154(b) by 0 days.

(21) Appl. No.: 09/764,451

(22) Filed: Jan. 19, 2001

(30) Foreign Application Priority Data

Jan. 20, 2000 (JP) ..... 2000-014211
Dec. 22, 2000 (JP) ..... 2000-390066

(51) Int. Cl.[7] ..... B43K 25/00

(52) U.S. Cl. ..... 401/92; 401/54; 401/65

(58) Field of Search ..... 401/52, 54, 65, 401/67, 92, 99, 109, 247

(56) References Cited

U.S. PATENT DOCUMENTS 6,039,484 A * 3/2000 Kageyama et al. ..... 401/52

* cited by examiner

*Primary Examiner*—Timothy L. Maust
*Assistant Examiner*—Peter deVore
(74) *Attorney, Agent, or Firm*—McGinn & Gibb, PLLC

(57) ABSTRACT

Disclosed is a double chuck type mechanical pencil and an internal writing mechanism thereof comprising a feed chuck for feeding a normal lead, and a tip chuck for holding the tip of a lead for reducing a residual lead. The double chuck type mechanical pencil comprises a lead tank provided movably in a longitudinal direction within a barrel, a feed chuck connected to the lead tank to feed leads, a chuck ring loosely fitted in the feed chuck, a sleeve provided externally of the feed chuck, a chuck spring provided between the sleeve and the lead tank, an inner tube provided externally of the sleeve and movable integrally with the sleeve, a cushion spring provided between the inner tube and the barrel, a tip chuck provided on the end part of the inner tube, a tip ring provided externally of the tip chuck, and a tip spring provided between the tip chuck and the inner tube.

3 Claims, 15 Drawing Sheets

DOUBLE CHUCK TYPE MECHANICAL PENCIL AND INTERNAL WRITING MECHANISM THEREOF

BACKGROUND OF THE INVENTION

1. Field of the Invention

This invention relates to a double chuck type mechanical pencil, and specifically to a double chuck type mechanical pencil and an internal writing mechanism thereof comprising a feed chuck for feeding a normal lead, and a tip chuck for holding a lead at the tip thereof to reduce a residual lead.

2. Description of the Prior Art

The conventional double chuck type mechanical pencil is excellent in that a residual lead is extremely reduced, but the number of parts is larger than that of the normal mechanical pencil and the construction is complicated. Therefore, it takes time to incorporate the parts into a barrel, and the cost is high. In particular, in the assembling step for conventional articles, pressing of a tip spring and an inner barrel has been carried out at a position that cannot be seen from outside within a cap. since in this case, the incorporating work is carried out in a groping state, it takes much time for inspection work after the incorporation.

Further, in conventional articles of this kind, a cap is used as a tip chuck to thereby fix the tip whereby holding of a lead is made positive and stabilized. However, since the tip becomes fixed so that a load applied to a lead becomes concentrated on one point of the tip chuck portion, as a result of which the lead is possibly broken.

SUMMARY OF THE INVENTION

This invention overcomes the disadvantages noted above with respect to the conventional double chuck type mechanical pencil as described above. It is an object of the invention to provide a double chuck type mechanical pencil and an internal writing mechanism thereof wherein in the assembling work of parts, an internal writing mechanism is inserted into a barrel as a mechanical pencil body, without directly incorporating parts into a barrel as in prior art, and a cap is screwed from the forward of the barrel or the internal writing mechanism is dropped from the rear of the barrel which is a so-called single shaft, whereby the assembling step is extremely simplified and the parts can be incorporated as a unit in a one-touch manner, thus materially facilitating mass production.

Further, according to this invention, inspection can be made prior to incorporation of an internal writing mechanism in the form of a unit into a barrel. Therefore, an object of the invention is to provide a double chuck type mechanical pencil and an internal writing mechanism thereof wherein the confirmation and inspection time after incorporation is shortened and articles of inferior quality in the form of finished articles can be reduced.

Furthermore, according to this invention, internal writing mechanisms including a tip chuck (a tip ring, a tip spring, a resilient frictional member, a feed chuck, a chuck ring, a chuck spring, an inner tube, a sleeve, a lead tank, a knock unit, etc.) are cushioned whereby a load caused by writing pressure concentrated on one point of a tip chuck portion is absorbed by cushion means so that a lead is hard to be broken and even a user having strong writing pressure can obtain a very smooth and good writing feeling. Therefore, an object of the invention is to provide a double chuck type mechanical pencil and an internal writing mechanism thereof which has a general usability.

For achieving the aforementioned objects, according to this invention, there is provided a double chuck type mechanical pencil comprising a tip chuck for holding a lead at an end opening of a barrel, and a feed chuck provided at the rear of the tip chuck and in which a lead tank is advanced by knocking operation to thereby feed the lead toward the tip chuck, wherein cushion means for absorbing a load caused by writing pressure against the tip chuck is provided at the rear of the tip chuck.

Further, an internal writing mechanism of the double chuck type mechanical pencil according to this invention comprises a lead tank for receiving leads, a feed chuck connected to the lead tank to feed the leads, a chuck ring loosely fitted in the feed chuck, a sleeve provided externally of the feed chuck, a chuck spring provided between the sleeve and the lead tank, an inner tube provided externally of the sleeve and having engaging means between it and the sleeve, a tip chuck fixedly mounted on the end part relative to the inner tube, and a tip spring provided between the tip chuck and the inner tube.

Further, the double chuck type mechanical pencil according to this invention comprises a lead tank provided movably in a longitudinal direction within a barrel, a feed chuck connected to the lead tank to feed a lead, a chuck ring loosely fitted in the feed chuck, a sleeve provided externally of the feed chuck and engaged movably with the barrel, a chuck spring provided between the sleeve and the lead tank, an inner tube provided externally of the sleeve, fitted with the sleeve and is movable integrally, a tip chuck provide at the end part of the inner tube, a tip ring provided externally of the tip chuck, and a tip spring provided between the tip chuck and the inner tube.

DESCRIPTION OF THE PREFERRED EMBODIMENTS

A double chuck type mechanical pencil and an internal writing mechanism thereof according to the respective embodiments of this invention will be described in detail with reference to the accompanying drawings.

Figure 1:
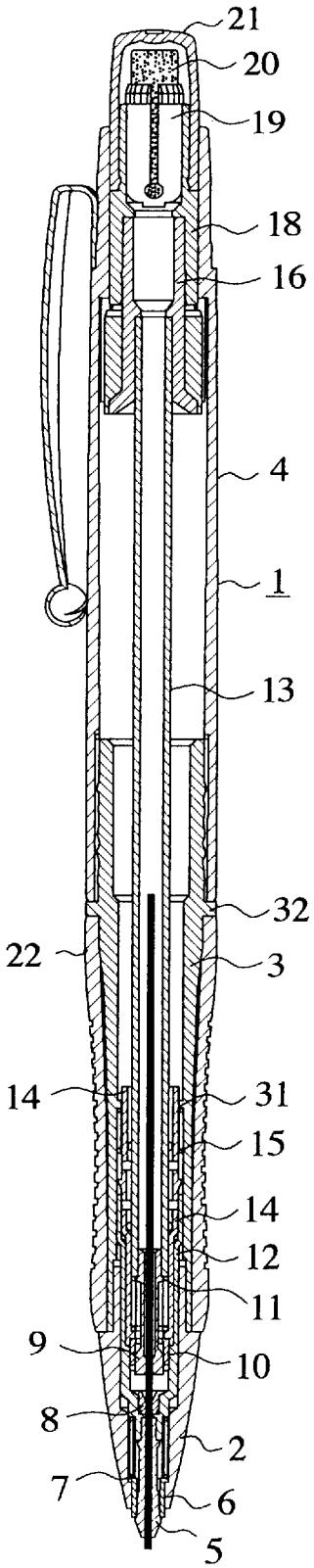
FIG. 1 is a longitudinal sectional view of a double chuck type mechanical pencil according to Embodiment 1 of this invention.
Figure 2:
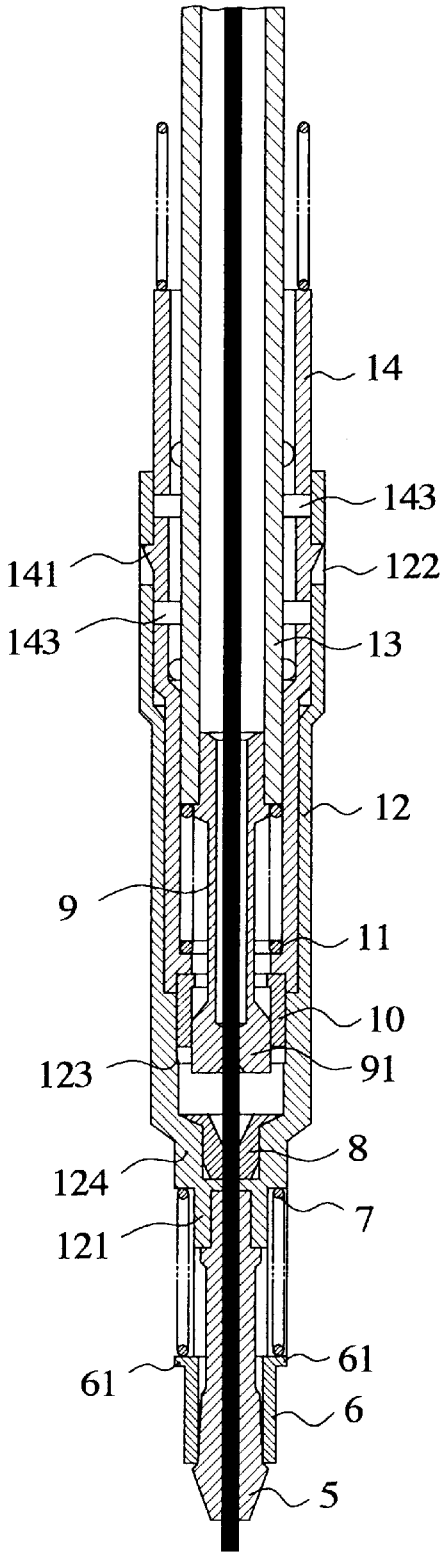
FIG. 2 is an enlarged view showing an internal writing mechanism of FIG. 1.

FIGS. 1 and 2 show a mechanical pencil according to Embodiment 1 of this invention. In the figures, a barrel 1 comprises a front shaft 3 having a cap at the front part and a rear shaft 4 provided at the rear of the front shaft 3, and a longitudinally movable internal writing mechanism (FIG. 2) is provided within the barrel 1.

The cap 2 and the barrel 1 may be of either a removable screwing construction or non-removable press-fitting construction or an integral molding. The internal writing mechanism is wholly formed to be a unit, and comprises a tip chuck 5, a tip ring 6, a tip spring 7, an elastic frictional member 8, a feed chuck 9, a chuck ring 10, a chuck spring 11, an inner tube 12, a lead tank 13, a sleeve 14, a cushion spring and so on.

More specifically, the internal writing mechanism has a knock unit described later detachably mounted thereon, and the lead tank 13 for receiving a writing lead is provided movably in a longitudinal direction of the barrel 1. The feed chuck 9 for feeding a lead by knocking operation is press-fitted and fixedly mounted on the front part of the lead tank 13. The lead tank 13 and the feed chuck 9 may be connected through a chuck joint not shown. Further, the chuck ring 10 is loosely fitted in a tip chuck portion 91.

The inner tube 12 having the convergent end chuck 5 fixedly mounted thereon is provided in the outer circumference of the feed chuck 9. That is, the inner tube 12 has a small-diameter mounting portion 12 having the tip chuck 5 press-fitted and fixedly mounted on the front end thereof, and is oppositely formed at the rear wall with an engaging hole 122 at which the sleeve 14 is engaged described later. The cushion spring 15 which is a resilient member (cushion means) for absorbing a load generated by writing pressure is provided between the rear end of the inner tube 12 and an annular rib 31 provided on the inner wall of the front shaft 3.

The inner tube 12 is internally provided with the sleeve 14 in a concentric circular fashion in section with the inner tube 12 integrally. That is, the sleeve 14 is formed on the rear outer wall with an engaging projection 141, so that when the sleeve 14 is set to the inner tube, the engaging projection is engaged at an engaging hole 122 of the inner tube 2, after which both of them cooperate integrally. From a viewpoint of the readiness of incorporation and the reliability of engagement, preferably, the engaging projection 141 comprises, as shown in the figures, a stood upright portion at the rear end and a slope portion which descends forward from the stood upright portion at the rear end thereof. Further, it is advantageous that if a plurality of slots 143 are formed widthwise of the sleeve 14, an error can be absorbed even if parts are irregular.

Internally of the sleeve 14, the lead tank 13 having the feed chuck 9 fixedly mounted at the extreme end movably extends from the rear of the barrel 1. More specifically, the feed chuck 9 is press-fitted and fixedly mounted at the extreme end of the lead tank 13, and the chuck ring 10 is loosely fitted in the feed chuck 9 as mentioned previously.

When the feed chuck 9 is advanced together with the lead tank 1 by the knocking operation, the extreme end of the chuck ring 10 comes into contact with a shoulder portion 123 (FIG. 2) formed in the inner circumference of the inner tube 12 during the advancement and is engaged. When the feed chuck 9 is further advanced in this state, the chuck ring 10 is disengaged from the feed chuck 9, which in turn, spreads and the lead drops by own weight. In the figures, numeral 8 designates an elastic frictional member (packing) provided within a small diameter portion 124 of the inner tube 12 to prevent the lead from dropping when the chuck is spread.

A knocking mechanism is provided within the rear end of the mechanical pencil. That is, a support member 16 is mounted at the rear end of the lead tank 13. An eraser 20 with an eraser holder 19 is mounted on the support member 16 through a mounting member 18. While in this embodiment, the support member 16 is a part formed separately from the mounting member 18, but of course, these may be a single part formed integrally. Further, a cap 21 is mounted on the eraser 20 easily removably. A grip member 22 formed of soft synthetic resin or the like is fitted between an annular projection 32 externally of the front shaft 3 and a difference in level portion externally of the cap.

For better understanding of the constitution according to Embodiment 1 described above, the assembling method therefor will be described in detail hereinafter.

First, the end unit will be described. The end ring 6 provided at the rear end with a collar-like stopper part 61 is inserted into the tip chuck 5, and the end spring 7 is then further inserted therein, after which the inner tube 12 is press-fitted and fixed at the rear part of the tip chuck 5. Afterwards, the frictional member 8 for holding a lead is inserted in place.

The preparation of the rear unit will be described below. The chuck ring 10 is inserted into the feed chuck 9 and inserted from the front end opening of the sleeve 14. Then, the chuck spring 11 is inserted from the rear end opening of the sleeve 14, after which the lead tank 13 is pressed in using a guide pin and press-fitted and fixed at the rear part of the feed chuck 9. The rear unit is inserted from the rear end opening of the inner tube 12 of the end unit, and the engaging projection 141 of the sleeve 14 of the rear unit is engaged and fixed at the engaging hole 122 located in the inner tube 12 of the end unit. Finally, the cushion spring 15 is incorporated externally of the sleeve 14, and the extreme end thereof is brought into contact with the rear end of the inner tube 12.

Further, with respect to the barrel 1 as the main body, the front shaft 3 is formed separately from the rear shaft 4. However, in this case, either press-fitting or screwing may be employed as a method, and there may be a so-called single shaft in which the cap 2 is formed integrally. Furthermore, with respect to the fixing of the cap 2, since the internal writing mechanism is formed as a unit, either press-fitting or screwing may be employed. In mounting the knocking unit, the mounting member 18 along with the eraser holder 19 are press-fitted into the lead tank 13, and the eraser 20 is further inserted, and the cap 21 is placed over. As described above, since complicated parts constituting the internal writing mechanism can be prepared in a unit form, there is an advantage that they can be incorporated into the barrel 1 simply to extremely facilitate the mass production.

The operation of the double chuck type mechanical pencil according to Embodiment 1 described above will be explained hereinafter.

First, when the knocking means at the rear end is knocked, the feed chuck 9 is advanced through the lead tank 13. Then, the extreme end of the chuck ring 10 comes into contact with the shoulder 123 formed in the inner circumference of the inner tube 12 during the advancement of the chuck 9 and is engaged. When the feed chuck 9 is further advanced in this state, the chuck ring 10 is disengaged from the chuck part 91 of the feed chuck 9 so that the feed chuck 9 spreads, and the lead drops by own weight.

Thereafter, the knocking is further repeated whereby the above operation is repeated so that the lead arrives at the tip chuck 5 and projects from the extreme end, placing in a written condition. When an excessively high writing pressure is applied to the tip chuck 5 during writing, the force thereof is transmitted to the inner tube 12 to which the tip chuck 5 is connected. However, since the cushion spring 15 which is a weak spring is placed in contact and engaged between the rear end of the inner tube 12 and the annular rib 31 as a stopper provided in the inner circumference of the front shaft 3 forming the barrel 1, the cushion spring 15 is compressed by the writing pressure. As a result, the tip chuck 5 is suitably withdrawn and the load generated by the writing pressure is absorbed so that the force is not applied to the lead directly, thus eliminating the possible breaking of the lead.

After completion of writing, when the knocking operation is done in the state that the tip of the projected lead is placed on the paper surface or the finger-tip, both the tip chuck 5 and the feed chuck 9 are spread open, and the lead can be received into the barrel 1. Further, even if the lead becomes worn and shortened, the tip chuck 5 has a support function and an extremely short residual lead (loss of lead) will suffice, thus being very economical.

Figure 3:
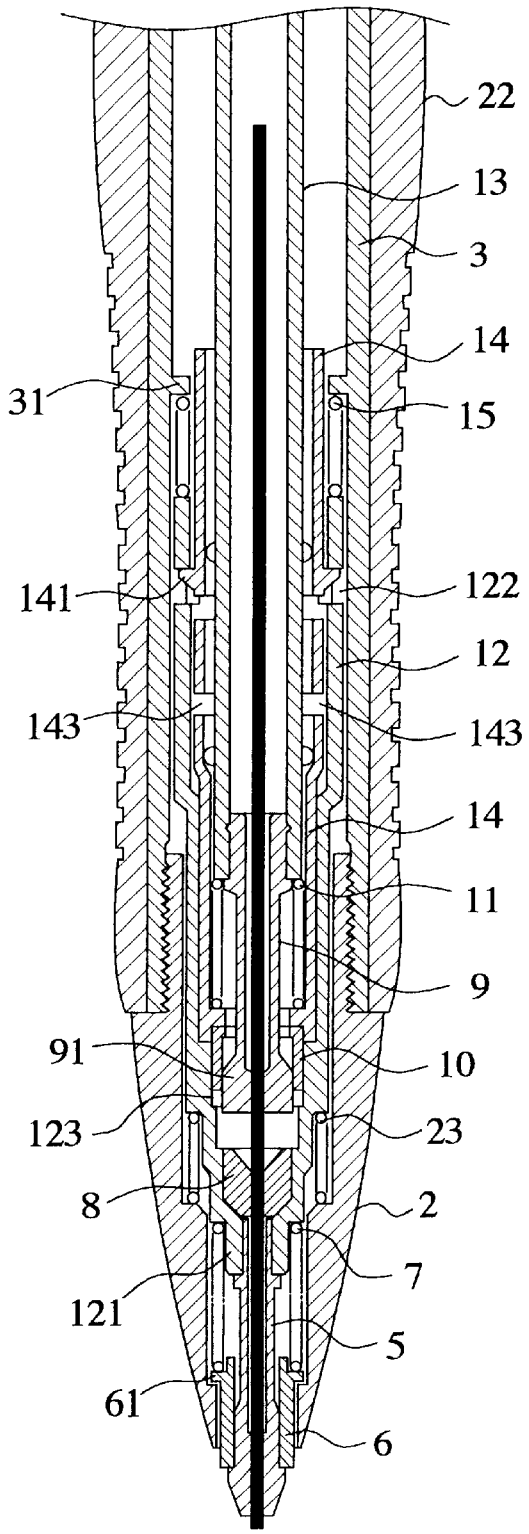
FIG. 3 is a longitudinal sectional view of a main part of a mechanical pencil according to Embodiment 2 of this invention.

FIG. 3 shows Embodiment 2 according to this invention. In this embodiment, an adjusting spring 23 is further provided between the cap 2 screwed into the barrel 1 and the inner tube 12 to reinforce the backward urging force of the end spring 7 so that the weak spring force of the end spring 7 poses no problem.

Figure 4:
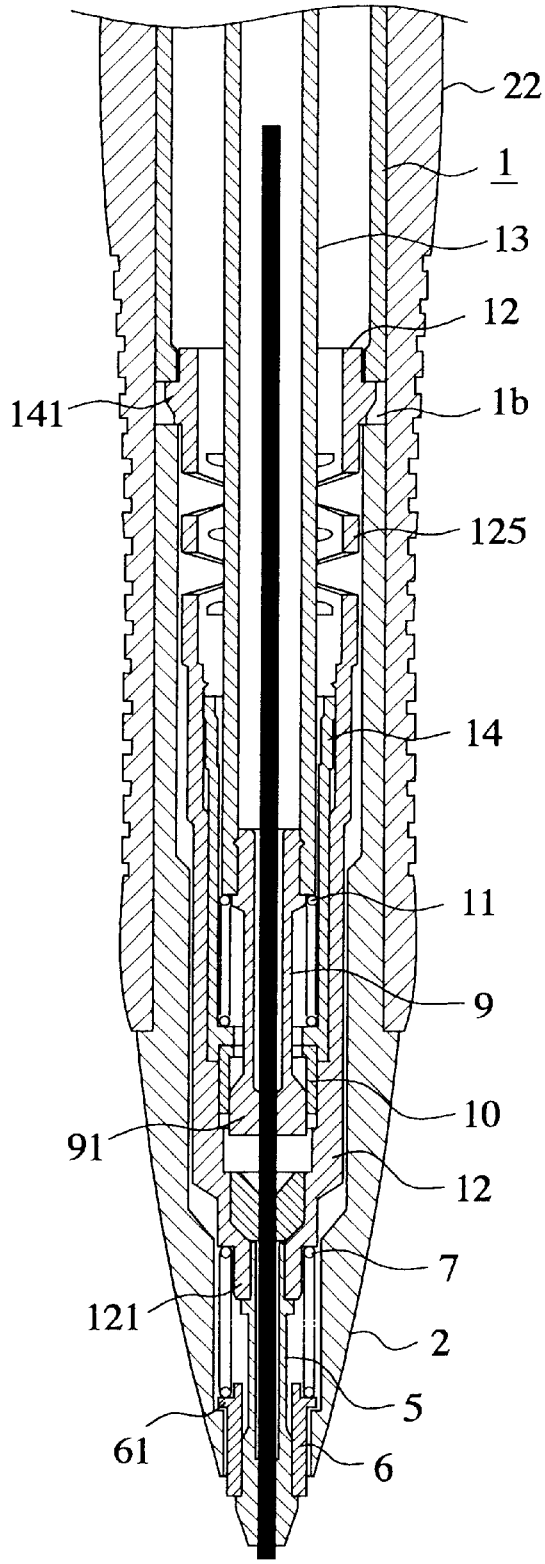
FIG. 4 is a longitudinal sectional view of a main part of a mechanical pencil according to Embodiment 3 of this invention.

FIG. 4 shows Embodiment 3 according to this invention. In this embodiment, the cushion spring 15 is not provided to reduce the number of parts. As cushion means for imparting a cushion function to the tip chuck 5, the inner tube 12 itself is provided with a cushion part 125.

As will be obvious from the figure, there is provided a cushion part 125 of a window-hole construction in which the rear side wall of the inner tube 12 is cut. The inner tube 12 itself is provided with the cushion part 125 whereby when excessively high writing pressure is applied to the tip chuck 5, the load is transmitted to the inner tube 12 directly. An engaging part 141 at the rear end of the inner tube 12 is engaged at a hole 1*b* formed in the side wall of the barrel 1, and is not moved back.

Figure 5:
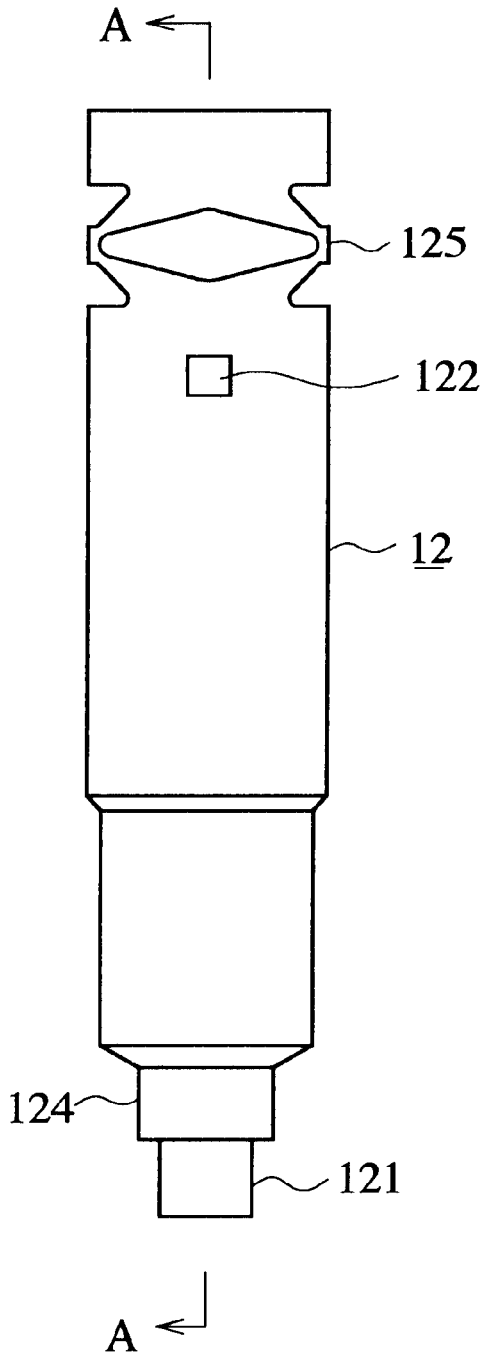
FIG. 5 is a front view showing a modified embodiment of an inner tube of FIG. 4.
Figure 6:
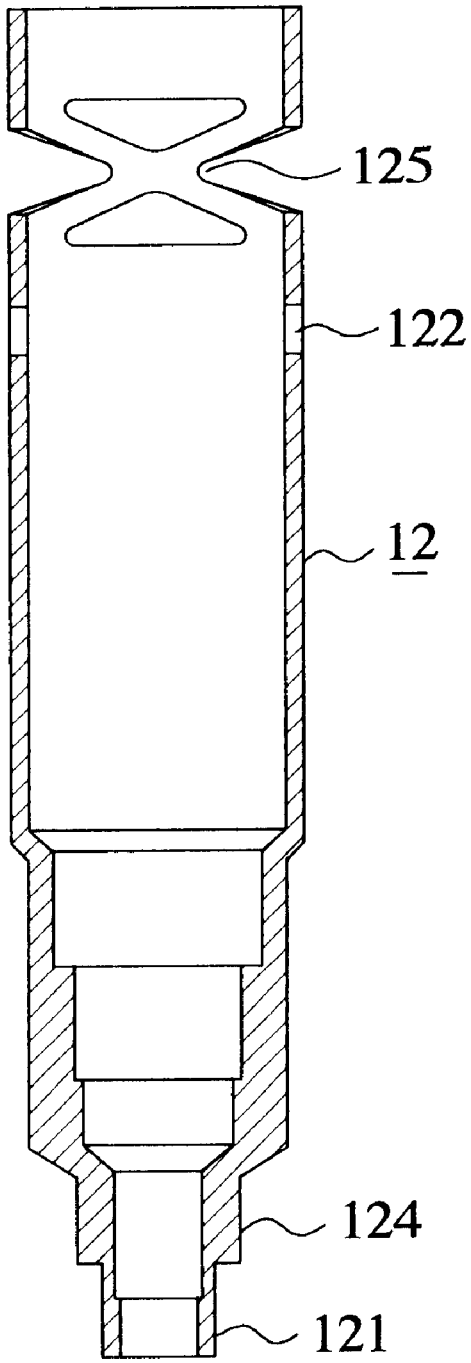
FIG. 6 is a longitudinal sectional view showing the inner tube of FIG. 5.

However, since the inner tube 12 itself is provided with the cushion part 125, the cushion part 125 is compressed by the excessively high writing pressure. As a result, since the tip chuck 5 is suitably moved back so that the writing pressure is not applied directly to the lead similarly to the above embodiment, and there is no possible breaking of the lead. Various shapes of the cushion par 125 of the inner tube 12 according to the above embodiment can be contemplated. For example, those shown in FIGS. 5 and 6 may be employed, and a so-called bellows construction may be also employed.

Figure 7:
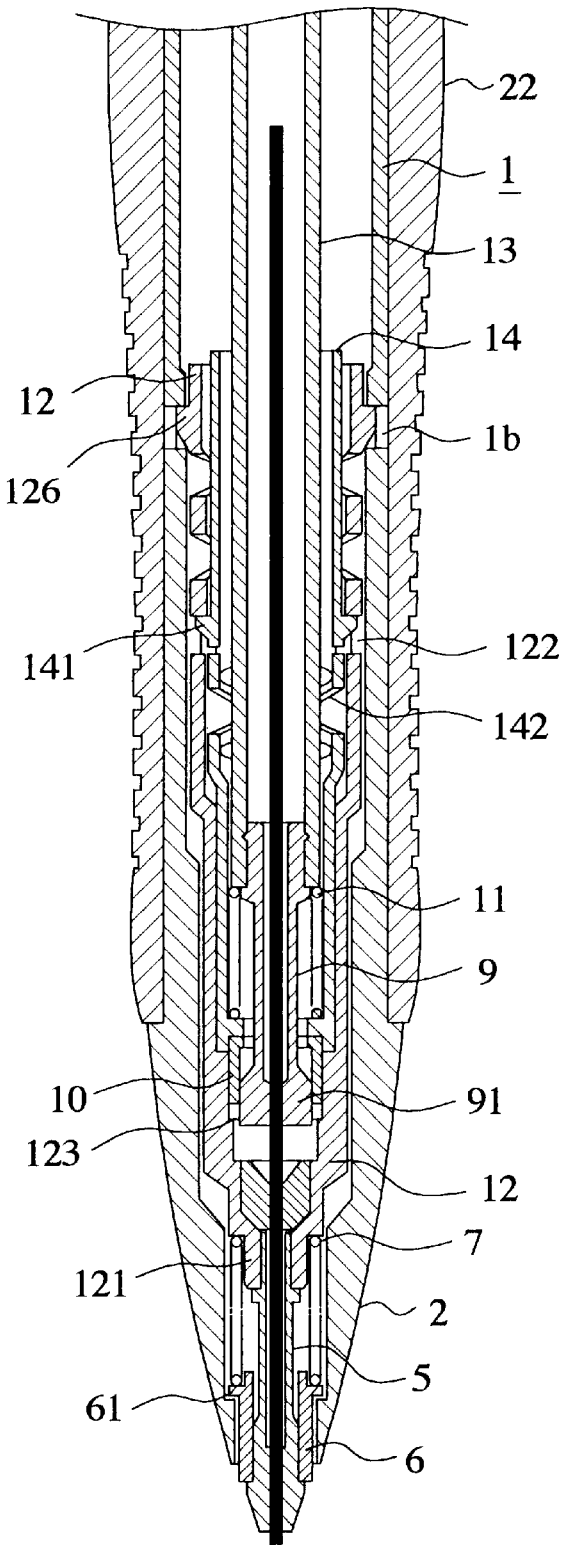
FIG. 7 is a longitudinal sectional view of a main part of a mechanical pencil according to Embodiment 4 of this invention.
Figure 8:
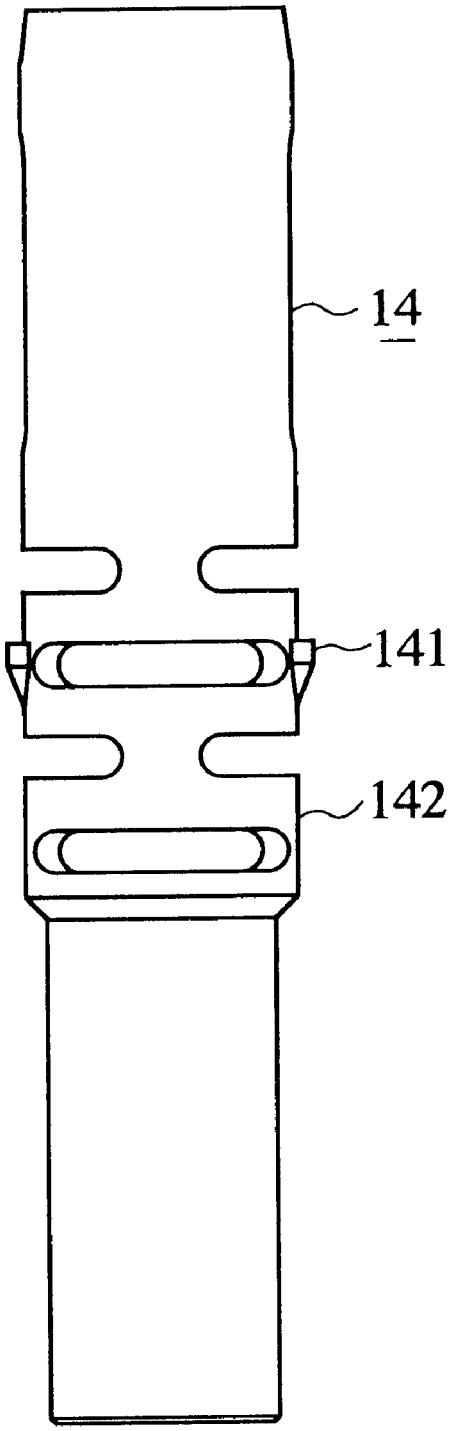
FIG. 8 is a front view showing a modified embodiment of a sleeve of FIG. 7.
Figure 9:
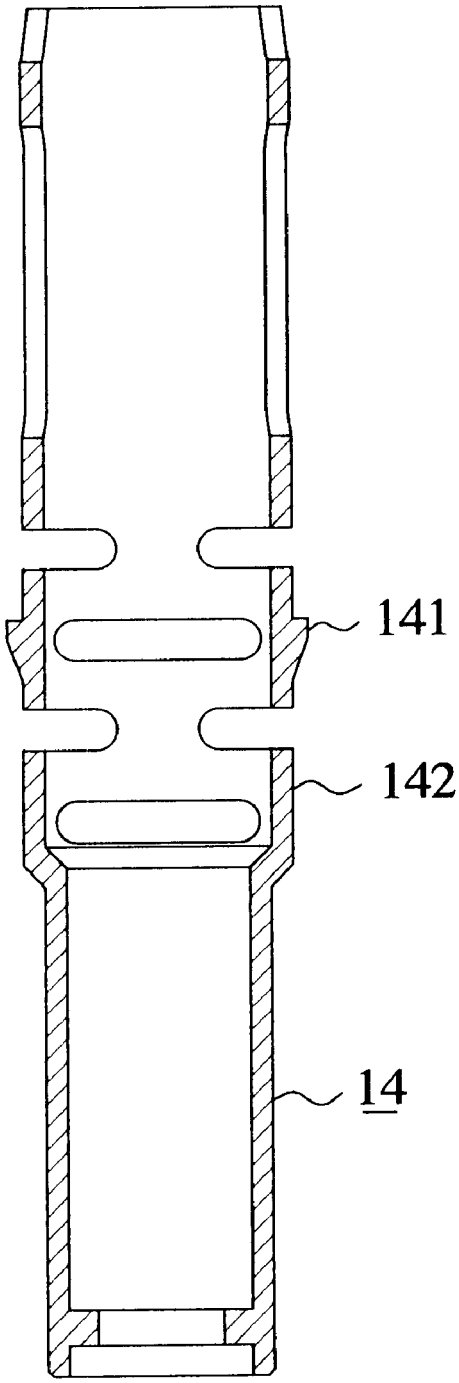
FIG. 9 is a longitudinal sectional view showing the sleeve of FIG. 8.
Figure 10:
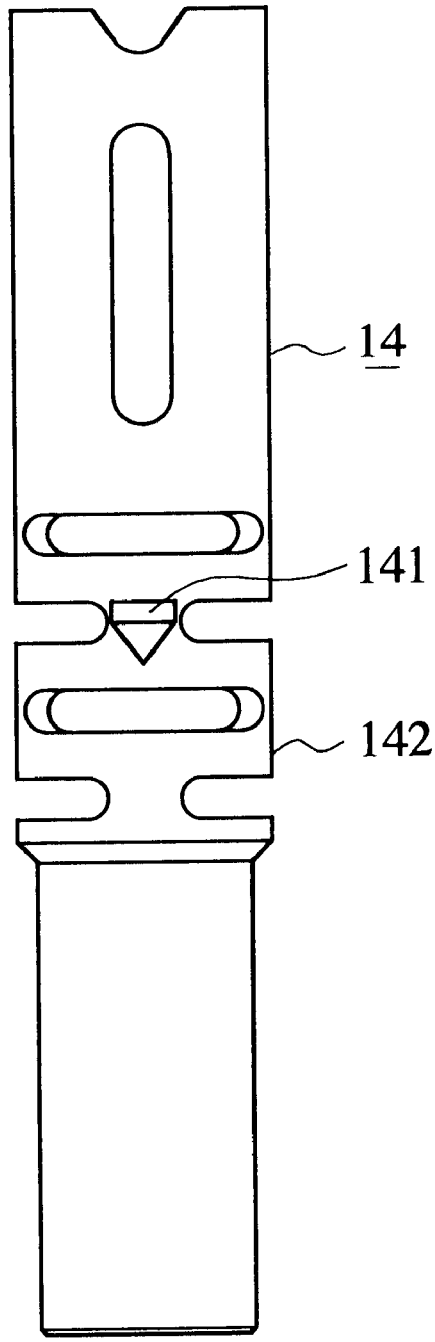
FIG. 10 is a side sectional view showing the sleeve of FIG. 8.

FIG. 7 shows Embodiment 4 according to this invention. In this case, the mechanical pencil body is a so-called single barrel in which the barrel 1 and the cap are formed integrally. The sleeve 14 integrally provided internally of the inner tube 12 is also formed with a cushion part 142 similar to the inner tube 12. Also in this embodiment, the cushion effect similar to the above embodiment can be obtained. Various shapes of the cushion part 142 of the sleeve 14 according to the above embodiment are contemplated. For example, those shown in FIGS. 8 to 10 may be employed.

In any of the above embodiments (the incorporated state), it is necessary for the end spring 7 to be weaker in the spring force than the chuck spring 11. This is because the tip chuck 5 has first to be spread open when knocked. When the load of the tip chuck 5 becomes higher than that of the feed chuck 9, breaking of the lead results. The optimum strength of the spring force of the cushion spring 15 is in the range of 300 to 500 g.

The construction and function of the inner tube 12 formed with the cushion part 125 are as follows: In the inner tube 12 as described, the feed chuck mechanism is engaged at the engaging hole 122 of the inner tube 12, and therefore, cushioning is not obtained unless the cushion part 125 is present more backward than the engaging hole 122 is.

However, in the inner tube 12 with the cushion part 125, the feed chuck mechanism (rear unit) is engaged at the engaging hole 122 of the inner tube 12, and therefore, cushioning is not obtained unless the cushion part 125 is present more backward than the engaging part of the feed chuck mechanism is. However, if the sleeve 14 is also cushioned as in FIG. 7, a double cushioning of the inner tube 12 and the sleeve 14 results. However, in this case, attention should be paid to the setting of a cushion load, but such a construction as described may be employed.

Figure 11:
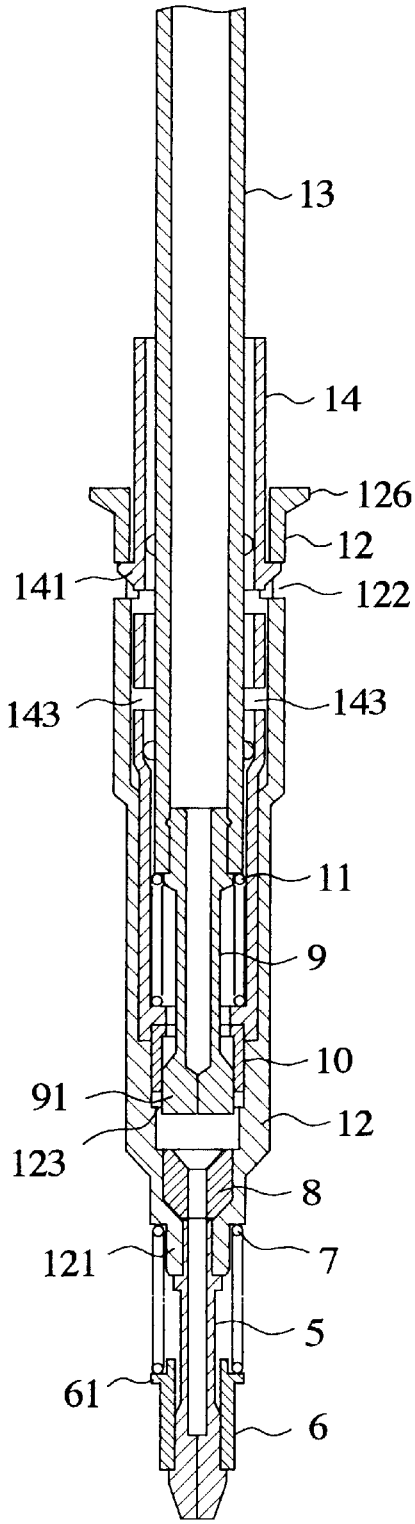
FIG. 11 is a longitudinal sectional view showing an internal writing mechanism prior to being incorporated according to Embodiment 5 of this invention.
Figure 12:
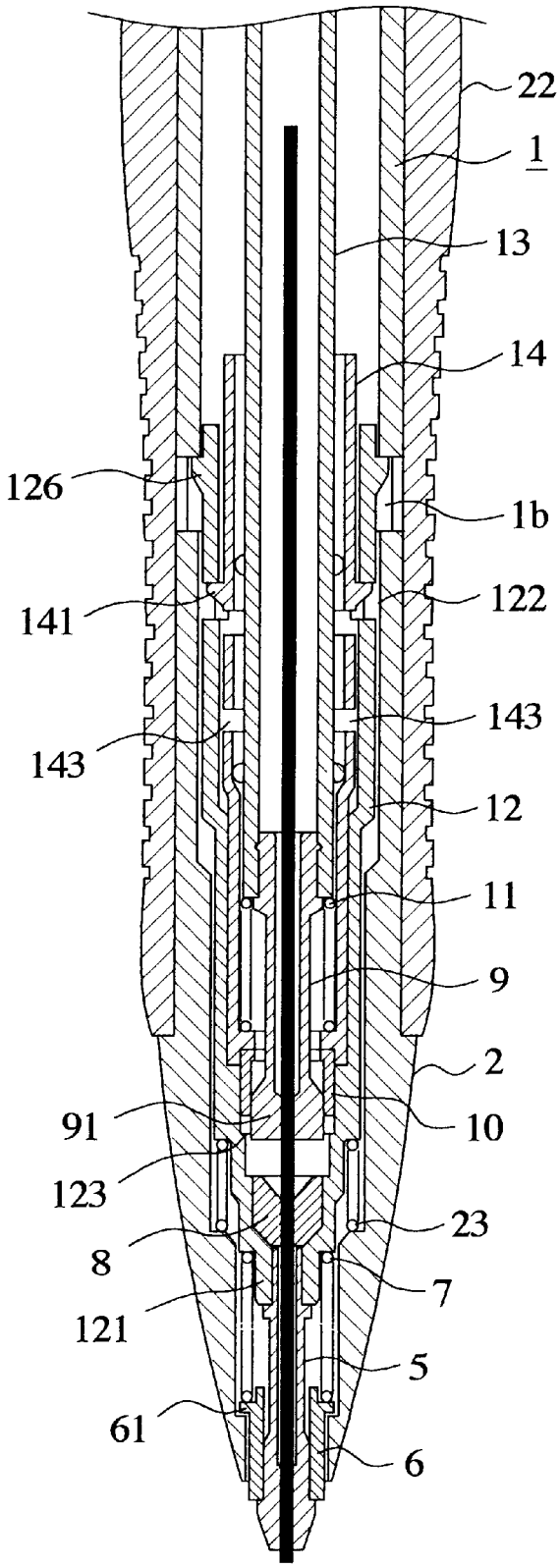
FIG. 12 is a longitudinal sectional view of a main part of the mechanical pencil having the internal mechanism of FIG. 11 incorporated.

FIGS. 11 and 12 are respectively longitudinal sectional views of main parts showing Embodiment 5 according to this invention. This embodiment is of a type in which the tip chuck 5 is not cushioned. The cap 2 is formed integrally with the barrel 1, and an engaging projection 126 provided backward of the inner tube 12 is engaged at a hole 1*b* of the barrel 1. Also in the embodiment as described, an internal writing mechanism (FIG. 11) in the form of a unit similar to the above embodiment is dropped from the opening at the rear end of the barrel 1 whereby the engaging projection 126 at the rear end of the inner tube 12 is engaged at the hole 1*b* of the barrel 1 to provide simple incorporation. The effect similar to that of the above embodiment is obtained.

Figure 13:
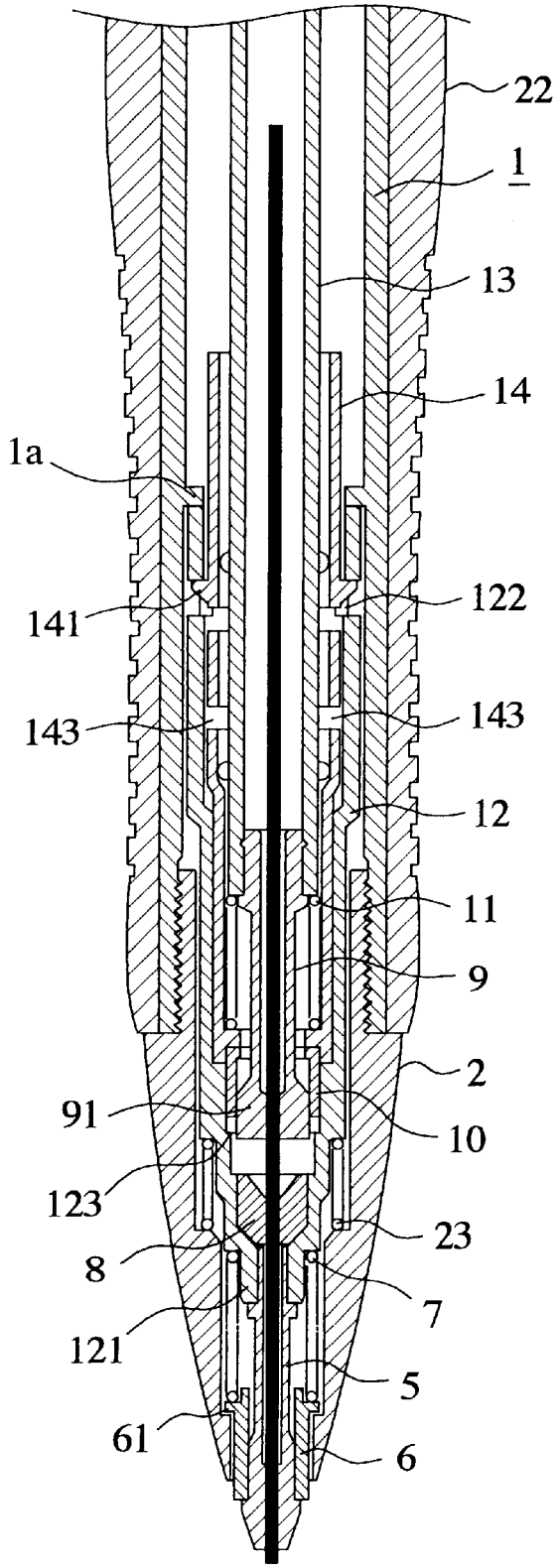
FIG. 13 is a longitudinal sectional view of a main part of a mechanical pencil according to Embodiment 6 of this invention.

FIG. 13 is a longitudinal sectional view of a main part showing Embodiment 6 according to this invention. Also in this embodiment, the tip chuck 5 is not cushioned, but the incorporation can be done very simply by screwing the cap 2 into the barrel 1 until the rear end of the inner tube 12 comes in contact with the engaging rib la within the barrel 1 from the front of the barrel 1 similar to the above embodiment.

Figure 14:
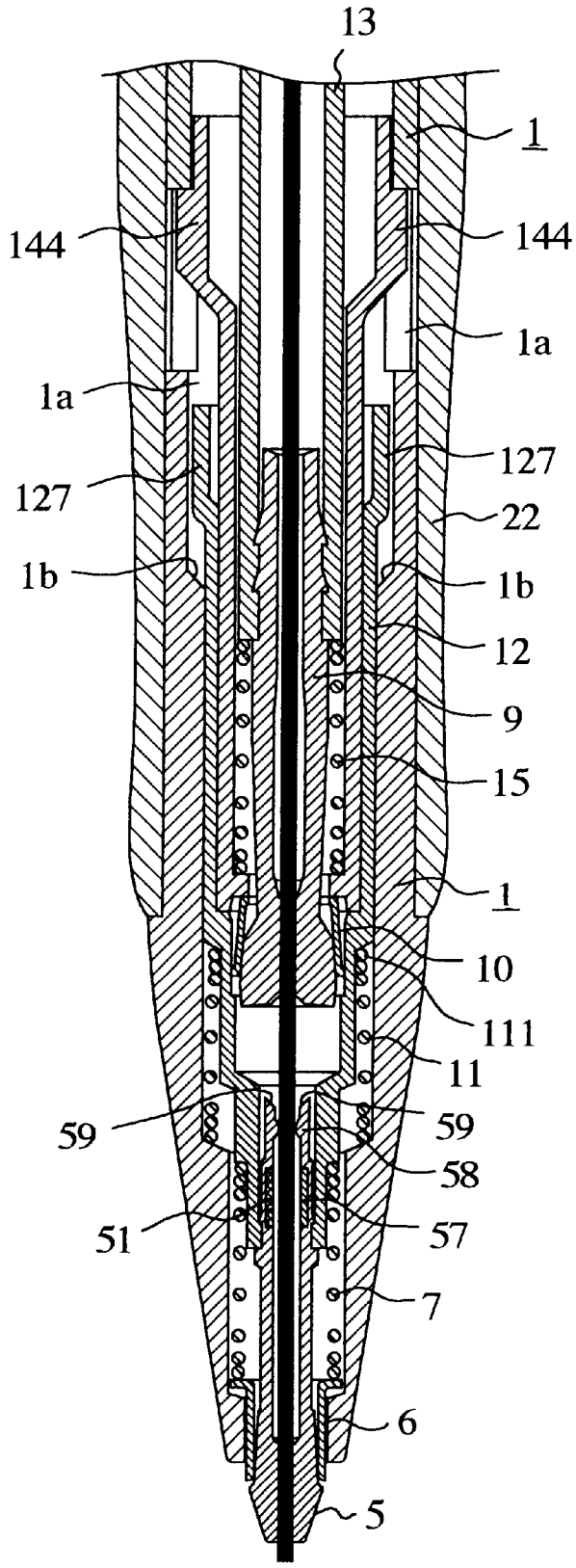
FIG. 14 is a longitudinal sectional view of a main part of a mechanical pencil according to Embodiment 7 of this invention.

FIG. 14 is a longitudinal sectional view of a main part showing Embodiment 7 according to this invention. In this embodiment, a long engaging hole la is formed opposite to the longitudinal direction of the side wall of the barrel 1 of the so-called single barrel. An engaging projection 144 formed on the outer wall at the rear of the sleeve 14 is engaged with the engaging hole la unrotatably but movably in a longitudinal direction. Within the sleeve 14 is mounted the inner tube 12 fitted in the sleeve 14 and integrally movably.

Figure 15:
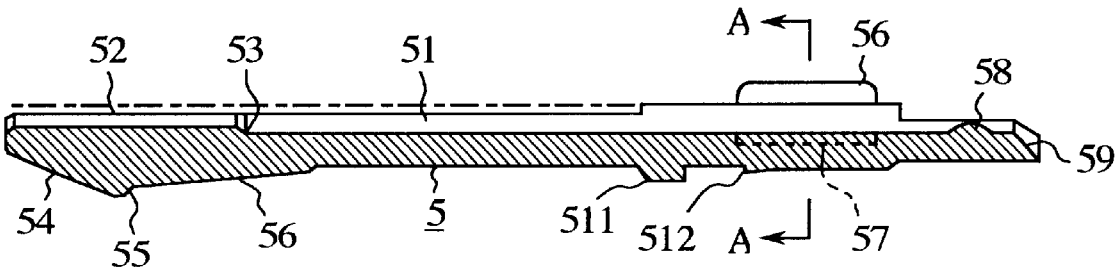
FIG. 15 is an enlarged longitudinal sectional view of a half part of a tip chuck in a mechanical pencil of FIG. 14.
Figure 16:
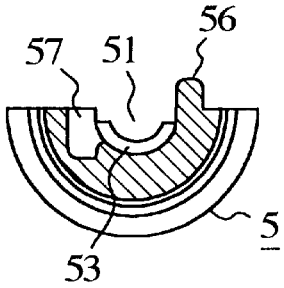
FIG. 16 is a cross-sectional view taken along the line A—A of FIG. 15.

Within a small diameter part 121 at the end of the inner tube 12 is press-fitted the tip chuck 5 in which a pair of plastic chuck half-parts are fitted. The tip chuck 5 will be described in detail with reference to FIGS. 15 and 16. There is formed an insert hole 51 into which a lead is inserted, the lead insert hole 51 being formed with a holding part 52 for holding a lead on the extreme end side thereof and being narrowed. The rear end surface of the holding part 52 is formed with a guide surface 53 so as to descend downward so that the lead may pass through.

On the outside corresponding to the holding part 52 is formed an end taper part 54 which gradually reduces in diameter forward, and a stopper projection 55 is provided at the rear end of the end taper part 54. At the rear of the stopper projection 55 is formed an inclined part 56 which descends downward more slightly than the taper part 54 does.

In the following, the rear part of the tip chuck 5 will be described. As will be apparent from FIG. 16, the elongated fitting projection 56 and the fitting groove 57 having the same shape as that of the fitting projection 56 are formed within the lead insert hole 51 in order to fit and assemble together chuck half parts divided into two parts. That is, these fitting projection 56 and fitting groove 57 function, when the half parts of the tip chuck 5 having the same shape are combined to assemble the tip chuck, to fit and integrate each other.

Further, the tip chuck is provided with a holding projection 58 as means for preventing a lead from falling off, which projects from the lead insert hole 51. This holding projection 58 may be one which partly comes in contact with a lead like a mere projection as long as it has a function for preventing a lead from falling off, or one which has a shape in contact with the whole circumference of a lead like an annular projection. Further, the tip chuck 5 is formed at the rear end with a taper part 59 for a guide in order to facilitate introduction of a lead.

Further, the tip chuck 5 is formed externally of the rear part with a stopper convex part 51 functioning as a stopper and an engaging projection 512 functioning as an anti-falling out, when the tip chuck 5 is press-fitted into a small diameter part 121 at the extreme end of the inner tube 12.

On the other hand, the chuck spring 11 is wound about the front shoulder part of the inner tube 12. A rear end part 111 of the chuck spring 11 is fitted in the front small diameter part 121 of the inner tube 12 to thereby provide an advantage that when these are incorporated as an internal unit into the barrel 1, the spring 11 is prevented from being fallen out.

In the figures, numeral 1*b* denotes an inclined guide part formed in the inner circumference of the barrel 1, and numeral 127 denotes a large diameter guide part formed at the rear of the inner tube 12, either of which functions as guide means when parts are incorporated from backward to facilitate incorporation.

The mechanical pencil according to Embodiment 7 of this invention may also obtain the function and effect similar to the above embodiments.

In terms of natural function, the tip chuck 5 of the double chuck type mechanical pencil according to this invention has to hold a lead to a degree that the lead does not fall out even when the former is spread open, and the spring force of the end spring 7 has to be weaker than that of the chuck spring 11.

By the provision of the constitution as described above, this invention can be prepared by forming complicated parts constituting an internal writing mechanism into a unit to thereby provide the effect that they can be incorporated simply and the mass production is very easy.

Further, according to this invention, there is an effect that with respect to the incorporating work of actual products, assembling can be completed by extremely simple steps of inserting an internal writing mechanism into the mechanical pencil, screwing a cap and so on.

Furthermore, according to this invention, there is an effect that internal writing mechanisms including a tip chuck (a tip ring, a tip spring, an elastic frictional member, a feed chuck, a chuck ring, a chuck spring, an inner tube, a sleeve, a lead tank, a knock unit, etc.) are cushioned whereby a load caused by writing pressure concentrated on one point of a tip chuck portion is absorbed by cushion means so that a lead is hard to be broken and even a user having strong writing pressure can obtain a very smooth and good writing feeling.

What is claimed is:

1. A double chuck type mechanical pencil comprising:

a tip chuck for holding a lead at an end opening of a barrel; and a feed chuck provided at the rear of the tip chuck and in which a lead tank is advanced by a knocking operation to thereby feed the lead toward the tip chuck, wherein cushion means for absorbing a load caused by a writing pressure to the tip chuck is provided at the rear of the tip chuck, said cushion means comprising a resilient member provided between an inner tube having a tip chuck at the front thereof and the barrel, wherein said elastic member comprises a cushion spring provided between the rear end of the inner tube and an annular ring formed in the inner circumference of the barrel.

2. A double chuck type mechanical pencil comprising:

a lead tank provided movably in a longitudinal direction within a barrel;

a feed chuck connected to the lead tank to feed the leads;

a chuck ring loosely fitted in the feed chuck;

a sleeve provided externally of the feed chuck;

a chuck spring provided between the sleeve and the lead tank;

an inner tube provided externally of the sleeve and being movable integrally with the sleeve;

a cushion spring provided between the inner tube and the barrel;

a tip chuck mounted on the end part relative to the inner tube;

a tip ring provided externally of the tip chuck; and a tip spring provided between the tip chuck and the inner tube.

3. The double chuck type mechanical pencil according to claim 2 wherein an adjusting spring is provided between said cap and said inner tube.

* * * * *